US005594254A

United States Patent [19]

Palmer

[11] Patent Number: 5,594,254

[45] Date of Patent: Jan. 14, 1997

[54] ILLUMINATOR DEVICE FOR USE WITH NIGHT VISION DEVICES

[75] Inventor: Gary L. Palmer, Vinton, Va.

[73] Assignee: ITT Corporation, New York, N.Y.

[21] Appl. No.: 564,386

[22] Filed: Nov. 29, 1995

[51] Int. Cl.[6] ..... F21V 33/00

[52] U.S. Cl. ..... 250/504 R; 362/109

[58] Field of Search ..... 250/504 R, 504 H; 362/109, 110

[56] References Cited

U.S. PATENT DOCUMENTS 4,707,595 11/1987 Meyers ..... 205/504 R

*Primary Examiner*—Jack I. Berman

*Attorney, Agent, or Firm*—Plevy & Associates; Patrick M. Hogan

[57] ABSTRACT

An present invention is an illuminator device designed to be coupled to the tripod mount of a night vision device which allows a user to adjust the direction of a beam of light projected by an illuminator relative to the line of sight of the night vision device. The illuminator device includes an light source and a mounting assembly. The mounting assembly is biased against the night vision device thereby maintaining the direction of a projected beam from the light source substantially parallel to the line of sight of the night vision device. The mounting assembly includes a rigid member whose longitudinal axis is maintained substantially perpendicular to the bottom surface the night vision device and a free-floating member attached to the illuminator whose position can be changed relative to the line of sight of the night vision device. An adjustable element is provided to change the position of the free-floating member relative to the night vision device thereby changing the angle of a projected beam of light relative to the line of sight of the night vision device.

20 Claims, 6 Drawing Sheets

ILLUMINATOR DEVICE FOR USE WITH NIGHT VISION DEVICES

FIELD OF THE INVENTION

The present invention relates generally to an illuminator device for use with night vision devices, and specifically to an illuminator device that attaches to the tripod mount of a night vision device and allows the user to adjust the angle of a projected beam of light relative to the line of sight of the night vision device.

BACKGROUND OF THE INVENTION

Night vision devices are widely used to provide military and other personnel with the ability to view objects or take pictures at night or during other low light conditions. Most night vision devices utilize an image intensifier that receives low intensity visible or non-visible light and converts the low intensity light into a visible image. In most situations, the night sky provides sufficient quantities of light for the night vision devices to operate effectively. However, there are some situations where there are insufficient quantities of ambient light available to effectively operate a night vision device. To overcome this problem, the prior art has provided illuminator devices for night vision devices which illuminate the objects to be viewed. Such illuminators devices are exemplified by U.S. Pat. No. 4,707,595 issued Nov. 17, 1987 to Meyers entitled INVISIBLE LIGHT BEAM PROJECTOR AND NIGHT VISION SYSTEM.

The prior an has provided illuminators that have been incorporated into the housing of the night vision device. A well known example of such an arrangement is the AN/PVS-7B night vision goggle military device. These integral illuminators have many inherent disadvantages. This arrangement causes the night vision device to be more bulky and more difficult to handle. It makes the night vision device more expensive to manufacture and to purchase. The illuminator draws power from the battery of the night vision device thereby causing the battery life to be reduced. Finally, these integral illuminators are wide beam illuminators for close object viewing and therefore suffer from the disadvantages of not being focusable, not being adjustable, and not being removable.

The prior art discloses brackets or other similar mounting devices for attaching illuminators to night vision devices. An example of such a mounting device is described in U.S. patent application No. 08/215,512 entitled ILLUMINATOR BRACKET FOR A NIGHT VISION DEVICE, assigned to ITT Corporation, the assignee herein. With this type of bracket, the optical axis of the illuminator remains fixed relative to the line of sight of the night vision device. It would be an advantage if the user were able to adjust the direction of the projected beam from an illuminator relative to the line of sight of the night vision device.

Also well known in the prior art are laser illuminators of the type that are typically used in conjunction with dries or handguns. There are several disadvantages to using such prior art laser illuminators in conjunction with a night vision device. These prior art laser illuminators tend to be difficult to mount and difficult to aim. In many cases, tools are required to change the direction of the beam of laser light relative to the direction of the gun barrel or line of sight of an optical device. Finally, with such prior art laser illuminators, it is difficult to make fine adjustments in the direction of the projected beam of light, and fine adjustments are important when aiming at an object in the distance.

It is therefore an objective of the present invention illuminator device to allow a user to make fine adjustments in the angle of a beam of light projected by an illuminator relative to the line of sight of a night vision device.

It is a further objective to provide an illuminator device that is easy to use with one hand and does not require tools to adjust the direction of the beam of light.

It is a further objective to provide an illuminator device that is focusable, and does not draw on the battery power of the night vision device.

It is a further objective to provide an illuminator device that can be attached to the tripod mount of a night vision device.

SUMMARY OF THE INVENTION

The present invention is an illuminator device adapted to be coupled to the tripod mount of a night vision device which allows a user to adjust the direction of a projected beam of light relative to the line of sight of the night vision device. The illuminator device includes a light source and a mounting assembly. The mounting assembly is attached to the tripod mount on the night vision device. The mounting assembly is biased against the night vision device thereby maintaining the direction of a projected beam from the light source substantially parallel to the line of sight of the night vision device. The mounting assembly includes a rigid member whose longitudinal axis is maintained substantially perpendicular to the bottom surface the night vision device and a free-floating member attached to the illuminator whose position can be changed relative to the line of sight of the night vision device. An adjustable element is provided to change the position of the free-floating member relative to night vision device thereby changing the angle of a projected beam of light relative to the line of sight of the night vision device.

The mounting assembly comprises a mounting block, a thumb screw, a mounting screw, a spring, and a C-clip. A mounting screw aperture is disposed through the mounting block. The mounting screw aperture extends from the base of the mounting block to the bottom of an arcuate channel configured to receive the night vision device disposed at the top of the mounting block. The mounting screw and the spring are positioned within the mounting screw aperture. The threaded portion of the mounting screw emerges from the top of the mounting aperture, and the C-clip is locked onto the mounting screw to prevent the mounting screw from pulling out of the mounting screw aperture. The threaded portion of the mounting screw is attached to a tripod mount bore on the bottom of the night vision device. The spring applies a biasing force that maintains the mounting assembly substantially parallel to the line of sight of the night vision device. The thumb screw is disposed in a thumb screw aperture that is situated on the mounting block. The thumb screw is utilized to apply a downward force to the back of the mounting block thereby counteracting the biasing force of the spring. This changes the direction of the projected beam of light relative to the line of sight of the night vision device, thereby causing the beam of light to converge with the line of sight of the night vision device at the object being viewed.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Although the present invention illuminator device can be used with any optical device that has a tripod mount, the present invention is particularly well suited for use with a night vision device. Accordingly, the present invention will be described in conjunction with a night vision device in order to set forth the best mode contemplated for the invention. The night vision device is preferably a compact night vision monocular that contains a GEN III image intensifier. Such a device is exemplified by co-pending U.S. patent application Ser. No. 08/405,172 filed Mar. 3, 1995 by Palmer, the inventor herein, entitled COMPACT NIGHT VISION DEVICE which is hereby incorporated by reference.

Figure 1:
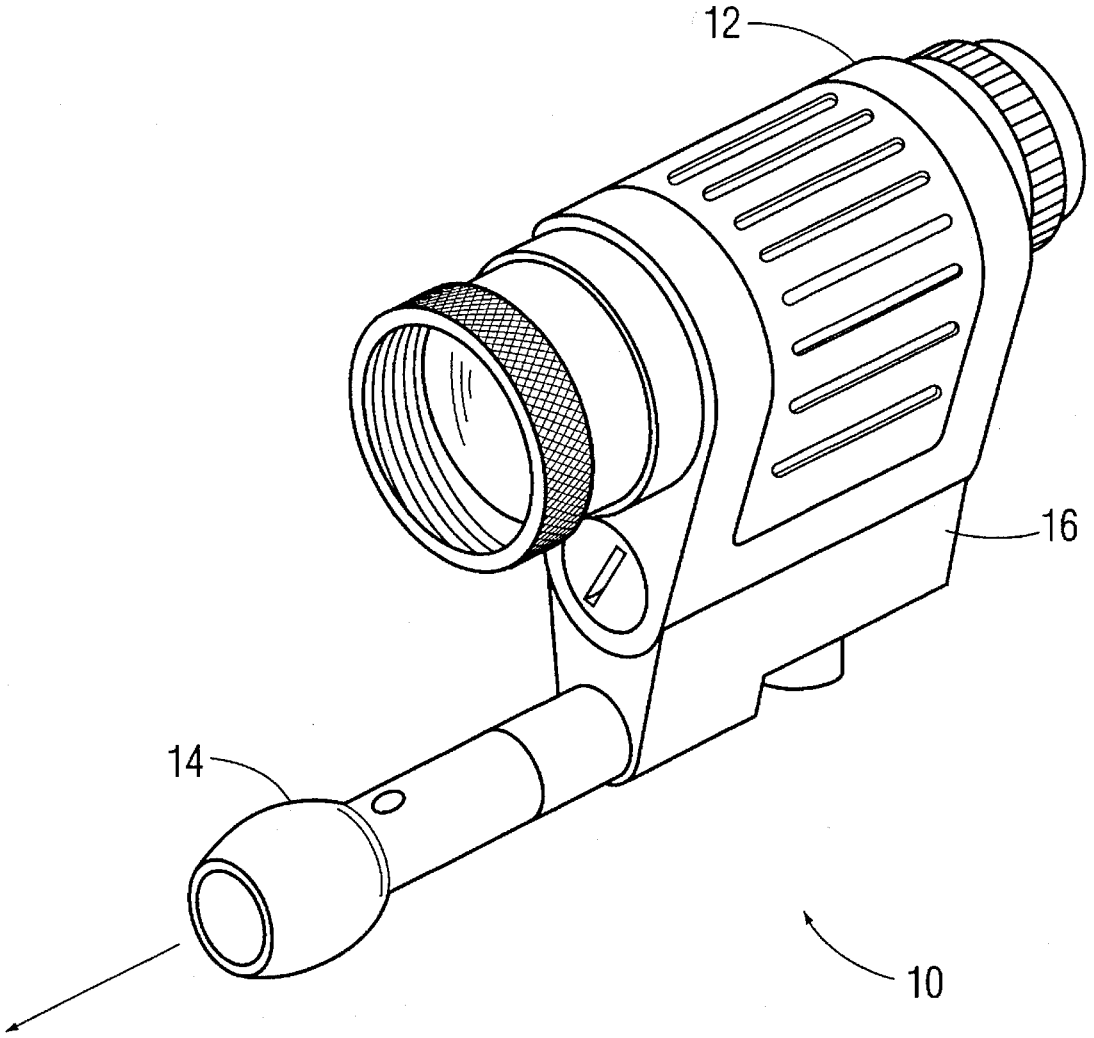
FIG. 1 is a perspective view of one preferred embodiment of the present invention illuminator device, shown in conjunction with a night vision monocular.

Referring to FIG. 1, there is shown one preferred embodiment of the present invention illuminator device 10 coupled to a night vision monocular 12 via the tripod mount aperture of the night vision device 12. The illuminator device 10 comprises an illuminator 14 and a mounting assembly 16. The illuminator 14 can be an LED or a laser light source that projects a beam of light in either the visible or non-visible spectrum. In the preferred embodiment, the illuminator 14 contains a near-infrared LED light source with a focusable objective lens assembly. Such illuminators are exemplified by co-pending U.S. application No. 08/398,346 filed on Mar. 31, 1995 entitled FLASHLIGHT ILLUMINATOR FOR A NIGHT VISION DEVICE assigned to ITT Corporation, the assignee herein, which is hereby incorporated by reference.

Figure 2A:
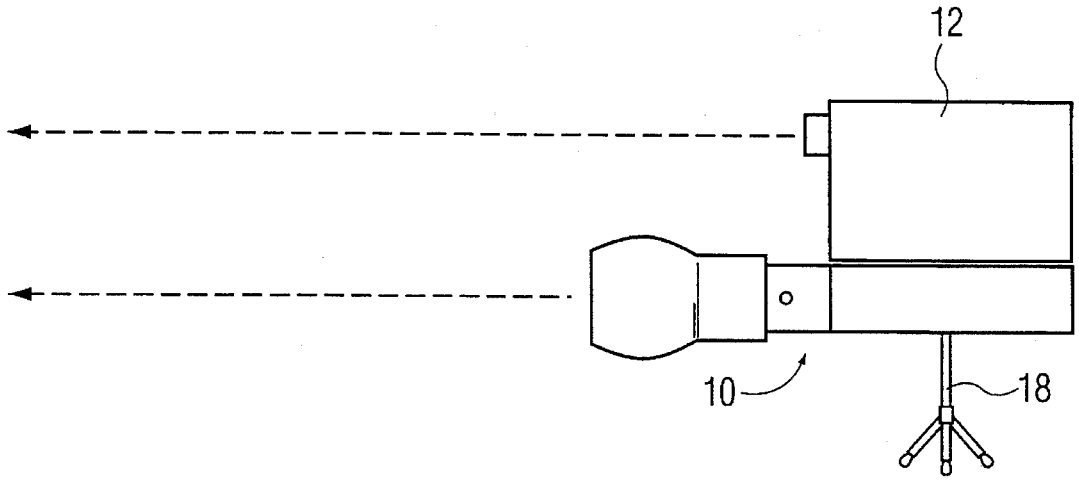
FIG. 2*a* and 2*b* are diagrammatic views that displays the operation of the present invention.
Figure 2B:
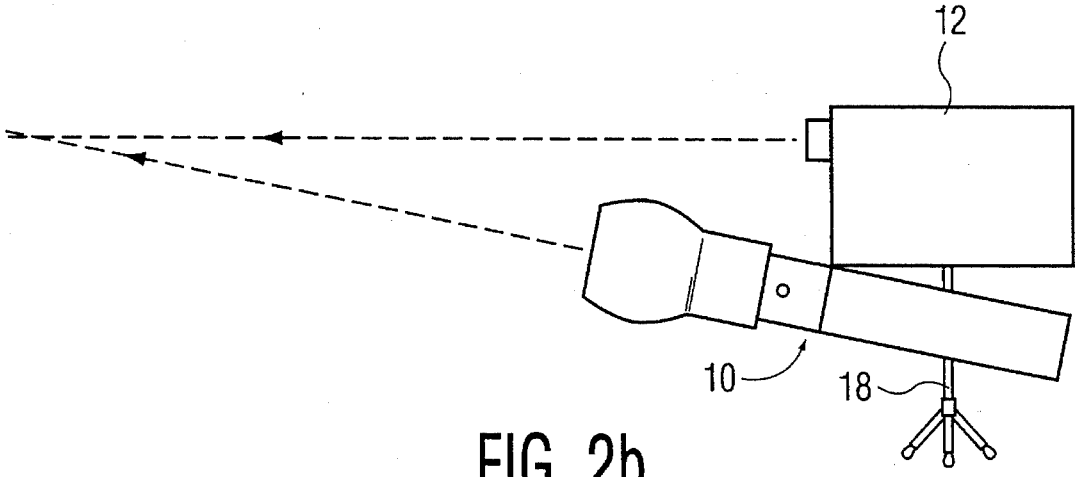

The purpose of the present invention is depicted in FIG. 2. The illuminator device 10 is used to illuminate an object being viewed through the night vision device 12. The illuminator device 10 typically projects a relatively narrow and uniform beam of light in order to illuminate an object that is some distance away. As shown in FIG. 2*a*, the line of sight of the night vision device 12 may be different from the optical axis of the illuminator device 10, so the illuminator may not illuminate the object desired to be viewed. Therefore, it is desirable to be able to adjust the angle between the night vision device's line of sight and the illuminator device's optical axis. In this manner, both optical axes can be converged at a desired point in the distance. Referring to FIG. 2*b*, the present invention illuminator device 10 and a night vision device 12 can be mounted on a tripod 18, and a user can make fine changes in the angle of a projected beam from the illuminator device 10 relative to line of sight of the night vision device 12. While the night vision device 12 and the tripod 18 remain stationary, the projected beam from the illuminator device 10 can be selectively directed to an object being viewed by the night vision device 12 relatively independent of the distance to the object being viewed.

Figure 3:
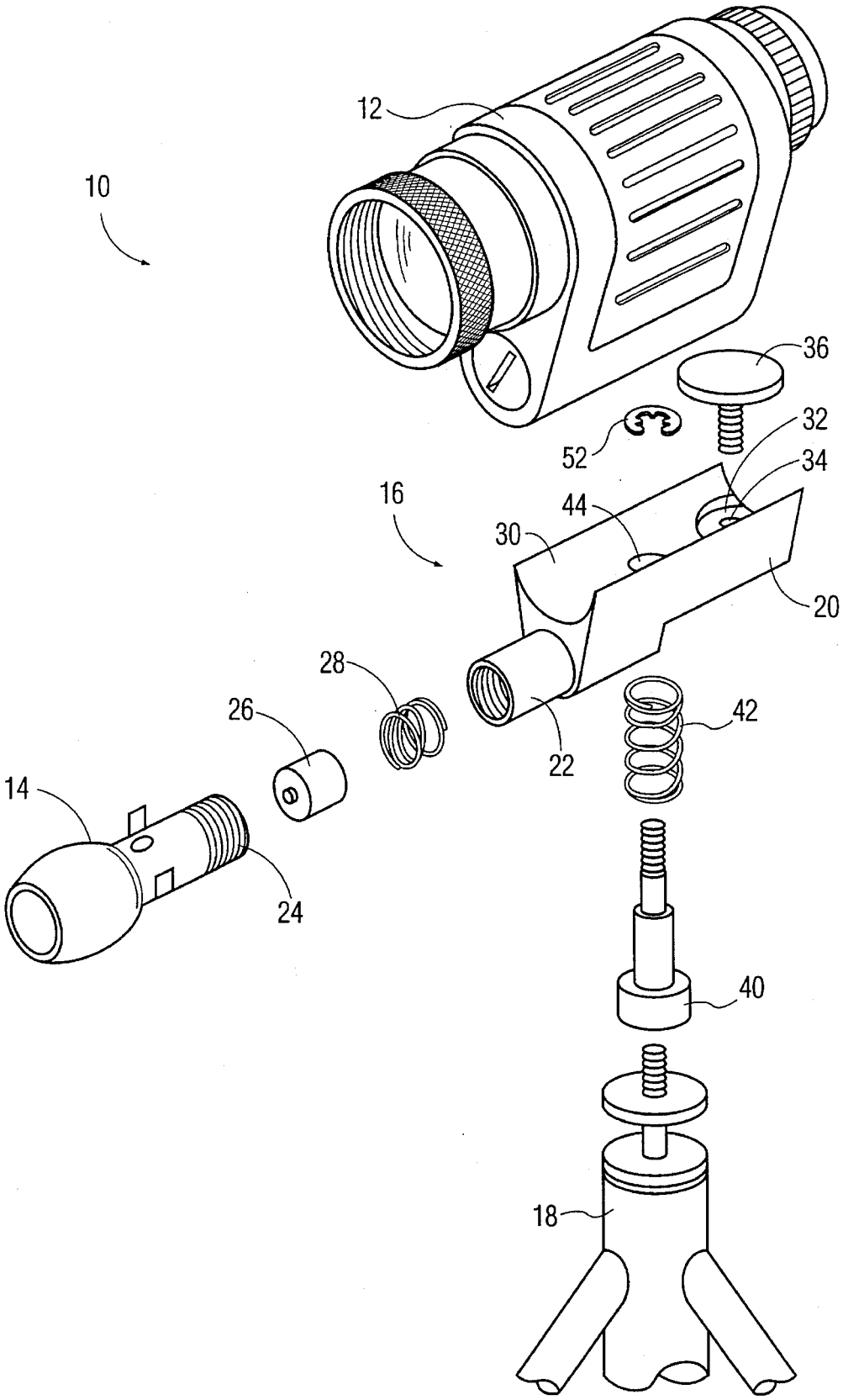
FIG. 3 is an exploded perspective view of the embodiment shown in FIG. 1.

Referring to FIG. 3, the mounting assembly 16 of the illuminator device 10 includes a mounting block 20. At the front of the mounting block 20 is disposed a battery port 22 that has threads that are sized and configured to engage the threaded region 24 of the illuminator 14. When the mounting block 20 is joined to the illuminator 14, a compartment is formed to contain the battery 26 and the spring 28, thereby forming a self contained, fully operational illuminator device.

Figure 4:
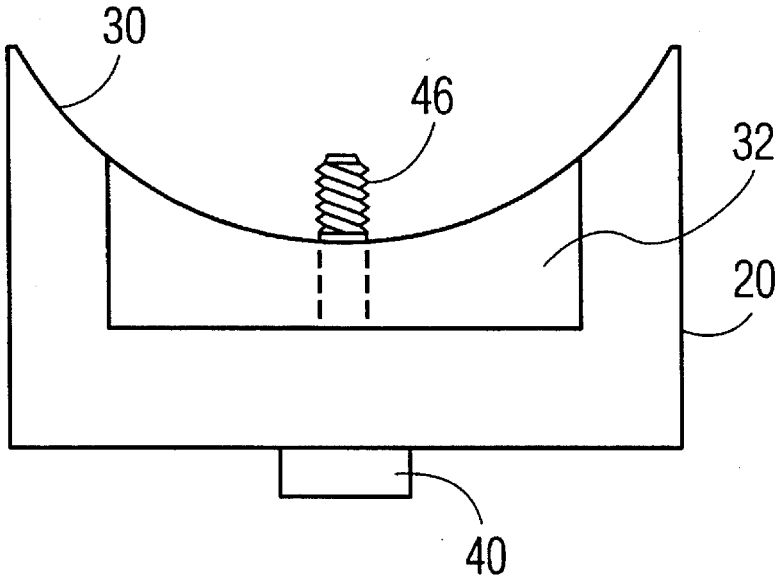
FIG. 4 is a back view of the mounting block of the present invention.
Figure 5:
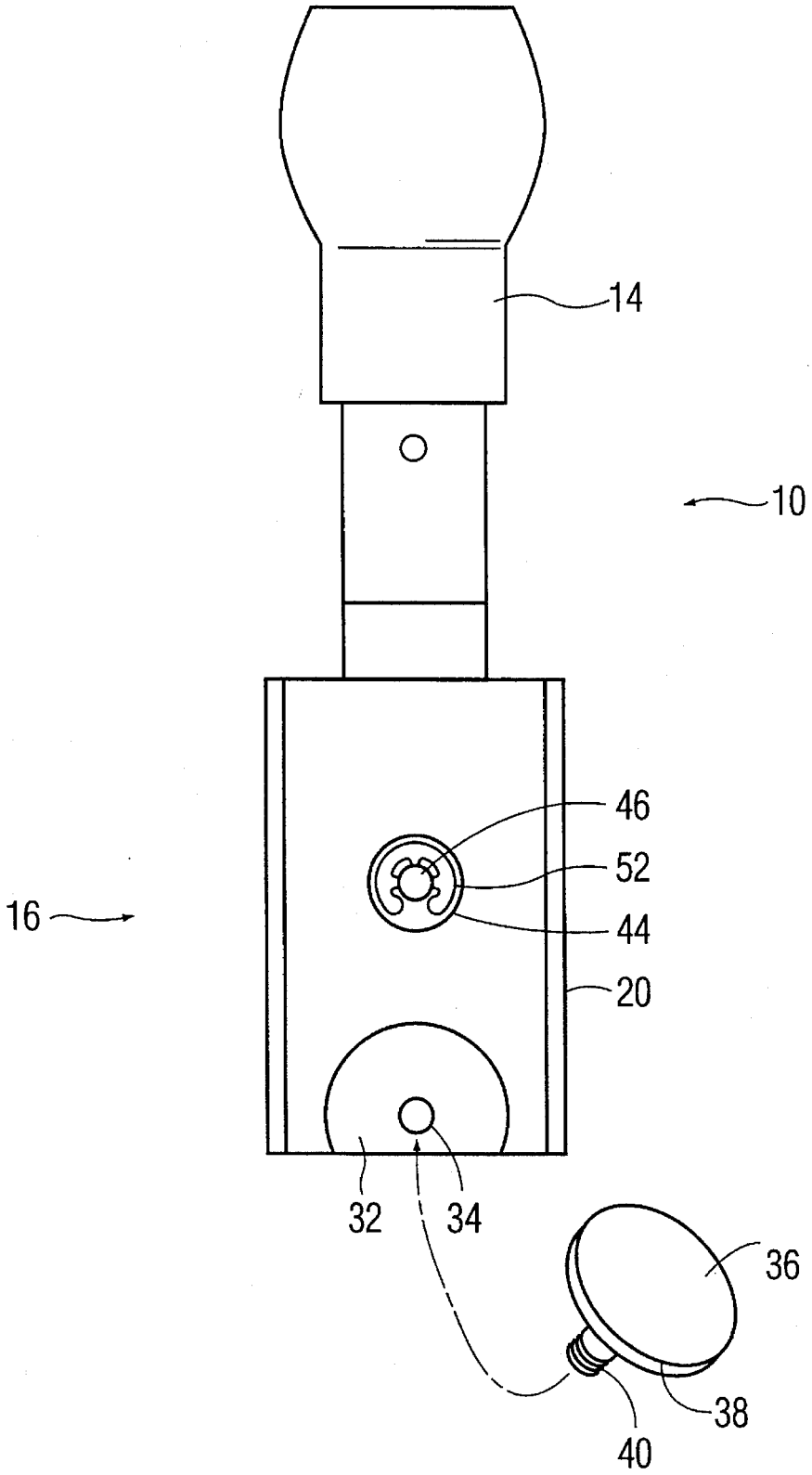
FIG. 5 is a top view of the mounting assembly of the present invention.

Referring to FIG. 3 in conjunction with FIG. 4, it can be seen that the top surface of the mounting block 20 has an arcuate channel 30 configured to be relatively similar in shape to the bottom surface of the night vision device 12. A thumb screw depression 32 is disposed at the end of the mounting block 20 opposite to the battery port 22. The thumb screw depression 32 descends to a depth that is lower than the base of the arcuate channel 30. In FIG. 5 it can be seen that the thumb screw depression 32 is shaped as a truncated circle. A threaded bore 34 configured to receive the thumb screw 36 is disposed at the center of the thumb screw depression 32.

The thumb screw 36 has a head 38 and a threaded shaft 40. The radius of the head 38 of the thumb screw 36 is smaller than the radius of the thumb screw depression 32. The threads of the thumb screw 36 are sized and configured to engage the threaded bore 34 at the center of the thumb screw depression 32. When the thumb screw 36 is fully engaged into the thumb screw depression 32, the head 38 of the thumb screw 36 sits below the level of the top of the mounting block 20. A portion of the head 38 of the thumb screw 36 extends beyond the back of the mounting block 20 because of the truncation of the mounting screw depression 32, thereby facilitating rotation of the thumb screw 36 with one hand or one finger. The head 38 of the thumb screw 36 can be knurled or otherwise textured to provide better tactile feel.

Figure 6:
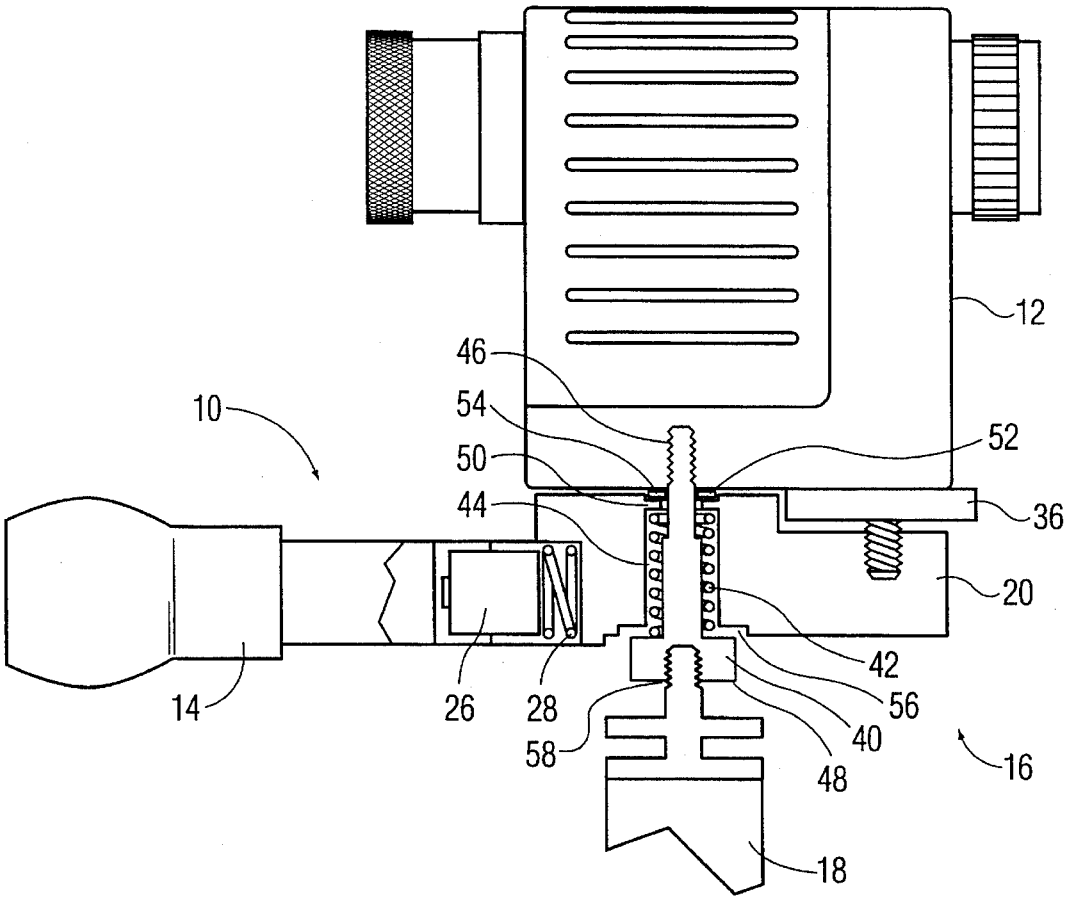
FIG. 6 is a side view of the present invention, partially cross-sectioned.

Referring now to FIG. 6, a mounting screw 40 and a spring 42 are positioned within a mounting screw aperture 44 in the mounting block 20. The threaded portion 46 of the mounting screw 40 extends through the mounting screw aperture 44 and extends past the top surface of the mounting block 20. When the mounting screw 40 is engaged into the tripod screw aperture on the night vision device 12, the spring 42 becomes compressed between the head 48 of the mounting screw 40 and a flange 50 within the mounting screw aperture 44. A C-clip 52 retains the mounting screw 40 and the spring 42 in the mounting screw aperture 44 when the mounting assembly 16 is not attached to a night vision device 12. The C-clip 52 lies in a depression 54 on the top surface of the mounting block 20 so that the C-clip 52 does not interfere with the abutment of the mounting block 20 on the night vision device 12. To accommodate the head 48 of the mounting screw 40, there is a counter bore 56 at the bottom of the mounting screw aperture 44.

When the top surface of the thumb screw 36 lies below the bottom surface of the night vision device 12, the biasing force of the spring 42 causes the top surface of the mounting block 20 to lie against the bottom surface of the night vision device 12. The mounting block 20 is not rigidly coupled to the night vision device 12, but rather the mounting block 20 is free floating and biased against the night vision device 12 by the compression force of the spring 42. In this configuration, the projected beam of illumination is substantially parallel to the line of sight of the night vision device.

When the thumb screw 36 is rotated counterclockwise, it abuts on the bottom of the night vision monocular 12. This causes a downward force to be applied to the back of the mounting block 20. This downward force counteracts the bias of the spring 42 and causes the back of the mounting block 20 to be lowered relative to the front. This changes the angle of the center line of a beam of light being projected by the illuminator device 10 relative to the line of sight of the night vision monocular 12, and allows the beam of light and the line of sight of the night vision device to converge.

The head 48 of the mounting screw 40 includes a threaded aperture 58 that is configured to engage the threaded member of the tripod 18. The illuminator device 10 and the night vision device 12 can therefore be mounted onto the tripod 18. Thus, while mounted on a tripod 18, the angle of the beam of light from the illuminator 14 can be adjusted relative to the line of sight of the night vision device 12.

It should be understood that the embodiments described herein are merely exemplary and that a person skilled in the art may make many variations and modifications to these embodiments utilizing functionally equivalent elements to those described herein. Any and all such variations or modifications as well as others which may be apparent to those skilled in the art, are intended to be included within the scope of the invention as defined by the appended claims.

What is claimed is:

1. An illuminator device for use with an optical device, said optical device having a tripod mount on a surface thereof, wherein said optical device has a predetermined line of sight, comprising:

a light source having a housing for projecting a beam of light along a predetermined center line;

a mounting structure attached to said housing;

biasing means for providing a biasing force that biases said mounting structure against the optical device in a first orientation, wherein said biasing means includes an elongated element that couples to the tripod mount of the optical device, thereby maintaining a predetermined directional relationship between said center line of said beam of light and the line of sight of the optical device; and an adjustable element disposed between said mounting structure and the optical device for selectively moving said mounting structure against said biasing force and away from said first orientation, thereby selectively altering said predetermined directional relationship between said center line of said light beam and the line of sight of the optical device.

2. The illuminator device according to claim 1 wherein said biasing means includes a spring disposed between said elongated element and said mounting structure for providing said biasing force against said mounting structure.

3. The illuminator device according to claim 1 wherein said mounting structure has a top surface and a bottom surface and wherein said mounting structure includes an aperture extending through said mounting structure from said top surface to said bottom surface wherein said aperture is sized and configured for said elongated element to fit therein.

4. The illuminator device according to claim 3 wherein said elongated element extends through said spring within said aperture.

5. The illuminator device according to claim 1 wherein said adjustable element is coupled to said mounting block and is selectively adjustable between a first position and a second position relative to said mounting block, said adjustable element abutting against the optical device at a point between said first position and said second position so as to displace said mounting block against said biasing force when said adjustable element is at said second position, thereby altering said predetermined directional relationship between said center line of said light beam and the line of sight of the optical device.

6. The illuminator device according to claim 1 wherein the optical device has a bottom surface and said mounting structure has a top surface configured to receive the bottom surface of the optical device when the bottom surface is biased against the bottom surface by said biasing force.

7. The illuminator device according to claim 6 wherein said top surface of said mounting structure is an arcuate channel.

8. The illuminator device according to claim 6 wherein said mounting structure includes a surface that abuts against the optical device when said mounting structure is at said first orientation, said adjustable element being disposed below said surface when at said first position and above said surface when at said second position, whereby said adjustment means interferes with the abutment of said mounting structure against the optical device when at said second position.

9. The illuminator device according to claim 1 wherein said mounting structure has a side surface, and said adjustable element is a screw having a head that extends beyond said side surface of said mounting structure.

10. The illuminator device according to claim 1 wherein said elongated element is a screw having a first end and an opposite second end, wherein said first end is configured to engage the tripod mount of the optical device and said second end is configured to mimic the tripod mount, whereby a tripod capable of being attached to the tripod mount can be attached to said second end.

11. The illuminator device of claim 1 wherein said light source includes a near-infrared LED light source.

12. The illuminator device of claim 1 wherein said light source includes a focusable objective lens assembly.

13. An assembly comprising:

a night vision device, said night vision device having a tripod mount, wherein said night vision device has a predetermined line of sight;

a light source having a housing for projecting a beam of light along a predetermined center line;

a mounting structure attached to said housing;

biasing means for providing a biasing force that biases said mounting structure against said night vision device in a first orientation, wherein said biasing means includes an elongated element that couples to the tripod mount of said night vision device, thereby maintaining a predetermined directional relationship between said center line of said beam of light and said line of sight of said night vision device; and an adjustable element disposed between said mounting structure and said night vision device for selectively moving said mounting structure against said biasing force and away from said first orientation, thereby selectively altering said predetermined directional relationship between said center line of said light beam and said line of sight of said night vision device.

14. The assembly according to claim 13 wherein said biasing means includes a spring disposed between said elongated element and said mounting structure for providing said biasing force against said mounting structure.

15. The assembly according to claim 13 wherein said mounting structure includes a top surface and a bottom surface, and wherein said mounting structure includes an aperture that extends from said top surface to said bottom surface that is sized and configured for said elongated element to fit therein.

16. The assembly according to claim 15 wherein said elongated element is disposed within said spring within said aperture.

17. The assembly according to claim 13 wherein said adjustable element is coupled to said mounting block and is selectively adjustable between a first position and a second position relative to said mounting block, said adjustable element abutting against said night vision device at a point between said first position and said second position so as to displace said mounting block against said biasing force when said adjustable element is at said second position, thereby altering said predetermined directional relationship between said center line of said light beam and said line of sight of said night vision device.

18. An illuminator device for use with a night vision device, said night vision device having a bottom surface and having a tripod mount on said bottom surface, and wherein said night vision device has a predetermined line of sight, comprising:

a illuminator for projecting a beam of light along a predetermined center line, thereby establishing a directional relationship between said center line of said beam of light and the line of sight of the night vision device;

a mounting block coextensive with said illuminator, said mounting block having an aperture therein, wherein said mounting block has a top surface conformed to receive the bottom surface of the night vision device;

a mounting screw which passes through said aperture for connecting said mounting block to the tripod mount of the night vision device;

biasing means disposed around said mounting screw, wherein said biasing means provides a biasing force to maintain said directional relationship between said center line of said beam of light and the line of sight of the night vision device in a substantially parallel orientation;

an adjustable element coupled to said mounting block, whereby said adjustable element is selectively adjustable between a first position and a second position relative to said mounting block, said adjustable element abutting against said night vision device at a point between said first position and said second position so as to counteract said biasing force, thereby tilting said mounting block and altering the directional relationship between said center line of said light beam and the line of sight of the night vision device.

19. The illuminator of claim 18 wherein said biasing means is a spring.

20. The illuminator of claim 18 wherein said adjustable element is a thumb screw.

* * * * *